US009543651B2

(12) United States Patent
Lin et al.

(10) Patent No.: US 9,543,651 B2
(45) Date of Patent: Jan. 10, 2017

(54) NEAR FIELD COMMUNICATION ANTENNA

(71) Applicant: Wistron NeWeb Corp., Hsinchu (TW)

(72) Inventors: Hsieh-Chih Lin, Hsinchu (TW); Liang-Kai Chen, Hsinchu (TW); Yi-Chun Wang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 152 days.

(21) Appl. No.: 14/253,108

(22) Filed: Apr. 15, 2014

(65) Prior Publication Data

US 2015/0145736 A1 May 28, 2015

(30) Foreign Application Priority Data

Nov. 22, 2013 (TW) ..... 102142577 A

(51) Int. Cl.
*H01Q 11/02* (2006.01)
*H01Q 7/00* (2006.01)
*H01Q 1/38* (2006.01)

(52) U.S. Cl.
CPC . *H01Q 7/00* (2013.01); *H01Q 1/38* (2013.01)

(58) Field of Classification Search
CPC ..... H01Q 7/00; H01Q 1/38
USPC ..... 343/742, 741
See application file for complete search history.

(56) References Cited

U.S. PATENT DOCUMENTS 5,424,527 A * 6/1995 Takahira ..... G06K 19/07749 235/492
6,028,559 A 2/2000 Satoh et al.
6,147,655 A * 11/2000 Roesner ..... H01Q 1/22 340/572.7
6,496,113 B2 * 12/2002 Lee ..... G06K 19/0726 340/572.7
6,600,219 B2 * 7/2003 Higuchi ..... G06K 19/07749 257/679
6,853,286 B2 * 2/2005 Nikawa ..... G06K 19/0726 29/602.1
6,992,634 B2 * 1/2006 Hashidate ..... H01Q 1/2216 343/700 MS
7,129,145 B2 * 10/2006 Kawamura ..... G06K 19/07749 257/E23.064

(Continued)

FOREIGN PATENT DOCUMENTS

CN 102460829 5/2012
CN 102474009 5/2012

(Continued)

OTHER PUBLICATIONS

AN2866 "Application Now: How to design a 13.56MHz customized tag antenna, Jan. 2009".*

*Primary Examiner* — Dieu H Duong
*Assistant Examiner* — Bamidele A Jegede
(74) *Attorney, Agent, or Firm* — Muncy, Geissler, Olds & Lowe PC

(57) ABSTRACT

A near field communication (NFC) antenna including a dielectric substrate, a coil, and a coupling structure is provided. The coil is disposed on the dielectric substrate. The coupling structure includes at least one coupling branch. Two ends of the coupling branch are respectively connected to two different connection points on the coil. The coupling structure is configured to improve the isotropic characteristics of the NFC antenna.

14 Claims, 7 Drawing Sheets

(56) References Cited

U.S. PATENT DOCUMENTS

| | | | | |
|---|---|---|---|---|
| 7,511,670 | B2 * | 3/2009 | Rao | H01Q 7/00 343/700 MS |
| 7,626,555 | B2 * | 12/2009 | Kalliokoski | H01Q 9/0471 343/702 |
| 8,297,516 | B2 * | 10/2012 | Fukushima | G06K 19/07749 235/487 |
| 8,514,135 | B2 * | 8/2013 | Jang | H01Q 1/2225 343/700 MS |
| 8,654,023 | B2 * | 2/2014 | Brown | H01Q 1/48 343/741 |
| 2010/0328173 | A1 * | 12/2010 | Rao | H01Q 1/242 343/742 |
| 2011/0275318 | A1 * | 11/2011 | Sato | H01Q 7/00 455/41.1 |
| 2013/0033403 | A1 * | 2/2013 | Oh | H01Q 7/00 343/741 |
| 2014/0218262 | A1 * | 8/2014 | Tsubaki | H01Q 7/00 343/867 |

FOREIGN PATENT DOCUMENTS

| | | | | |
|---|---|---|---|---|
| CN | 203134979 | | 8/2013 | |
| JP | WO 2013073314 | A1 * | 5/2013 | H01Q 7/00 |
| TW | M435696 | | 8/2012 | |

* cited by examiner

NEAR FIELD COMMUNICATION ANTENNA

CROSS REFERENCE TO RELATED APPLICATIONS

This application claims priority of Taiwan Patent Application No. 102142577 filed on Nov. 22, 2013, the entirety of which is incorporated by reference herein.

BACKGROUND OF THE INVENTION

Field of the Invention

The disclosure generally relates to a near field communication (NFC) antenna, and more particularly, to an NFC antenna with isotropic and high-efficiency characteristics.

Description of the Related Art

With the progress of mobile communication technology, portable electronic devices, such as portable computers, mobile phones, tablet computers, multimedia players, and other hybrid functional mobile devices, have become more common. To satisfy user demand, portable electronic devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi, Bluetooth, and WiMAX (Worldwide Interoperability for Microwave Access) systems and using frequency bands of 2.4 GHz, 3.5 GHz, 5.2 GHz, and 5.8 GHz.

A mobile device with the near field communication (NFC) function, for example, has an NFC antenna which is often designed in a rectangular card and also has a rectangular shape to fit the card. This design may cause the related reader to be incapable of receiving signals from the NFC antenna at all angles. For example, when the angle between the reader and the long side of the NFC antenna is set to 90 or 270 degrees, the reader may receive a relatively weak electric field, and it therefore degrades the communication quality of the NFC antenna.

BRIEF SUMMARY OF THE INVENTION

To solve the problem of the prior art, in one exemplary embodiment, the disclosure is directed to a near field communication (NFC) antenna, including: a dielectric substrate; a coil, disposed on the dielectric substrate; and a coupling structure, including at least one coupling branch, and two ends of the coupling branch being respectively connected to two different connection points on the coil. The coupling structure is configured to improve the isotropic characteristics of the NFC antenna.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Figure 1:
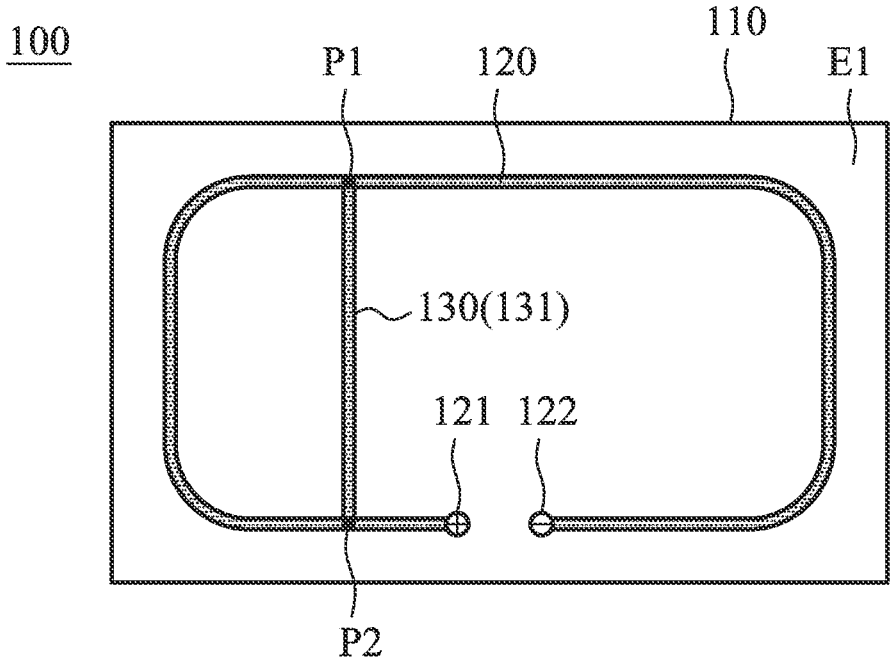
FIG. 1 shows a top view of a near field communication (NFC) antenna according to an embodiment of the invention.

FIG. 1 shows a top view of a near field communication (NFC) antenna 100 according to an embodiment of the invention. The NFC antenna 100 may be disposed in a mobile device, such as a smart phone, a tablet computer, or a notebook computer. As shown in FIG. 1, the NFC antenna 100 includes a dielectric substrate 110, a coil 120, and a coupling structure 130. The dielectric substrate 110 may be a flame retardant 4 (FR4) substrate. The coil 120 and the coupling structure 130 may be made of conductive materials, such as copper, silver, aluminum, iron, or their alloys. The coil 120 is disposed on the dielectric substrate 110. In some embodiments, the coil 120 is used as a main radiation element of the NFC antenna 100, and two ends 121 and 122 of the coil 120 are respectively connected to a positive electrode and a negative electrode of a signal source (not shown). The signal source may be a radio frequency (RF) module, and may be configured to excite the NFC antenna 100. The total number of turns of the coil 120 may be 1, 2, 3, 4, or more. In some embodiments, any end of the coil 120 is further connected to a matching circuit (not shown) to adjust the resonant length thereof. In such a design, the coil 120 may operate at or around a frequency of 13.56 MHz. The coupling structure 130 includes at least one coupling branch 131. Two ends of the coupling branch 130 are respectively connected to two different connection points P1 and P2 on the coil 120. In some embodiments, the coil 120 substantially has a rectangular shape which has two long sides and two short sides, and the connection points P1 and P2 are respectively substantially positioned at two long sides of the rectangular shape. In alternative embodiments, the connection points P1 and P2 are respectively substantially positioned at one long side and one short side of the rectangular shape. The coupling branch 131 of the coupling structure 130 is considered as a resistor connected in series to a capacitor. When the coupling branch 131 is connected to the coil 120, the impedance of the coupling branch 131 can enhance the coupling energy of the NFC antenna 100, and it therefore improves the isotropic characteristics of the NFC antenna 100.

Figure 2A:
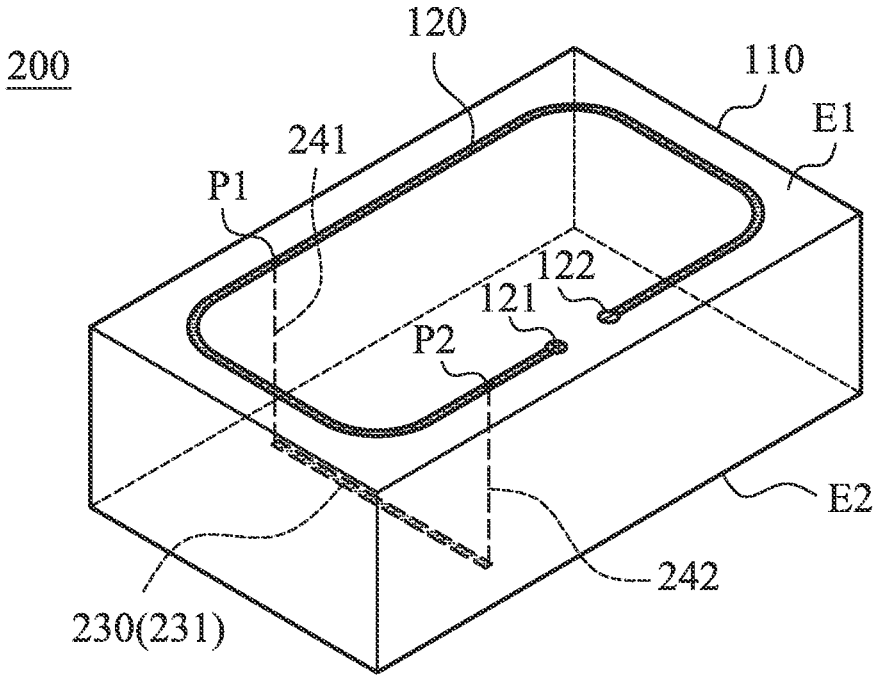
FIG. 2A shows a perspective view of an NFC antenna according to another embodiment of the invention.

In the embodiment of FIG. 1, the coil 120 and the coupling structure 130 are disposed on a same surface E1 of the dielectric substrate 110. However, the invention is not limited to the above. FIG. 2A shows a perspective view of an NFC antenna 200 according to another embodiment of the invention. In the embodiment of FIG. 2A, the coil 120 and a coupling structure 230 of the NFC antenna 200 are respectively disposed on two opposite surfaces E1 and E2 of the dielectric substrate 110. The NFC antenna 200 further includes at least two conductive vias 241 and 242 which are formed in the dielectric substrate 110, and two ends of at least one branch 231 of the coupling structure 230 are respectively connected through the conductive vias 241 and 242 to two connection points P1 and P2 on the coil 120.

Figure 2B:
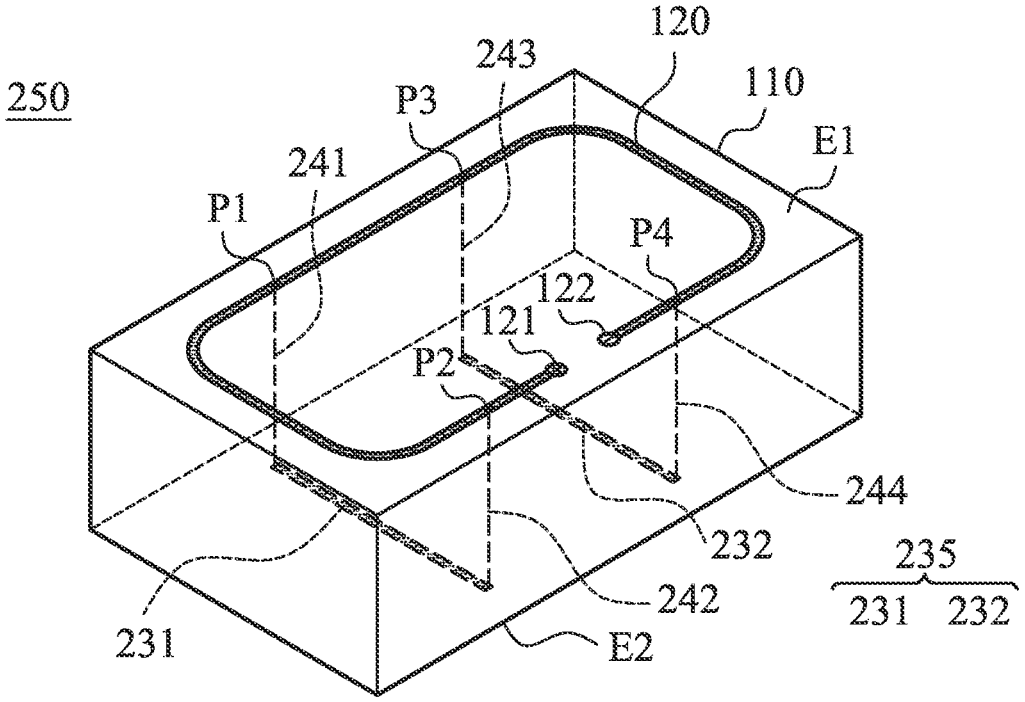
FIG. 2B shows a perspective view of an NFC antenna according to another embodiment of the invention.

FIG. 2B shows a perspective view of an NFC antenna 250 according to another embodiment of the invention. FIG. 2B is similar to FIG. 2A. In the embodiment of FIG. 2B, the coil 120 and a coupling structure 235 of the NFC antenna 250 are respectively disposed on two opposite surfaces E1 and E2 of the dielectric substrate 110. The NFC antenna 250 further includes four conductive vias 241, 242, 243, and 244 which are formed in the dielectric substrate 110. Two ends of one coupling branch 231 of the coupling structure 235 are respectively connected through the conductive vias 241 and 242 to two connection points P1 and P2 on the coil 120, and two ends of another coupling branch 232 of the coupling structure 235 are respectively connected through the conductive vias 243 and 244 to two additional connection points P3 and P4 on the coil 120. In comparison to FIG. 2A, the NFC antenna 250 of FIG. 2B shows better symmetry and therefore provides an enhanced isotropic characteristics. Note that the shapes of the above coupling branches are not limitations of the invention. For example, each of the above coupling branches may substantially have a straight-line shape, a square-bracket shape, a polyline shape, a semi-circular shape, or a smooth curved shape.

Figure 3:
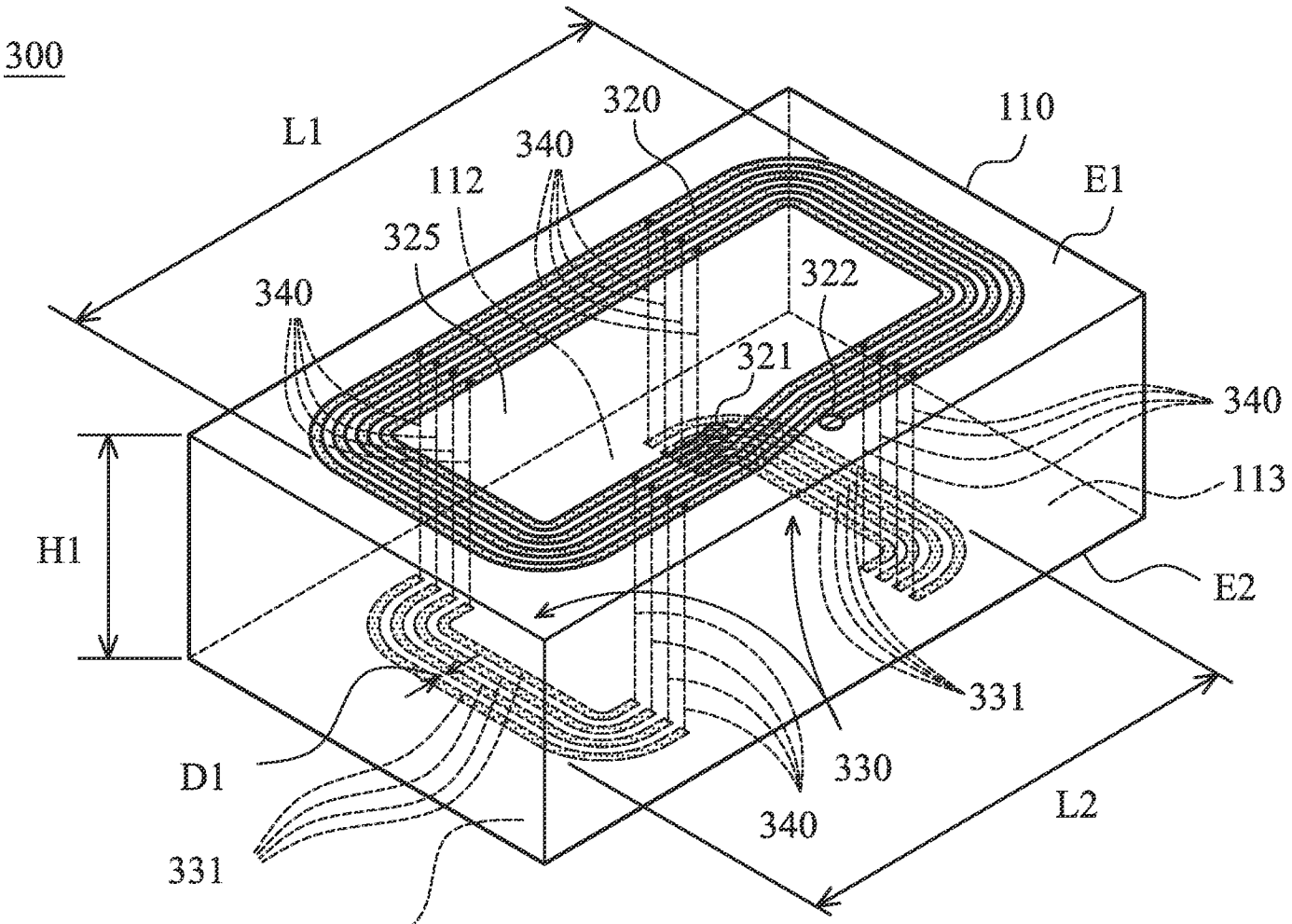
FIG. 3 shows a perspective view of an NFC antenna according to a preferred embodiment of the invention.

FIG. 3 shows a perspective view of an NFC antenna 300 according to an embodiment of the invention. As shown in FIG. 3, the NFC antenna 300 includes a dielectric substrate 110, a coil 320, and a coupling structure 330. The coil 320 and the coupling structure 330 are respectively disposed on two opposite surfaces E1 and E2 of the dielectric substrate 110. In comparison to the above embodiments, the coupling structure 330 of the NFC antenna 300 includes more coupling branches 331, and the total number of turns of the coil 320 of the NFC antenna 300 is also more. In some embodiments, the total number of coupling branches 331 is exactly two times of the total number of turns of the coil 320, such that they can be connected to each other symmetrically. For example, the total number of coupling branches 331 may be 8, and the total number of turns of the coil 320 may be 4, but it is not limited thereto. The NFC antenna 300 may further include multiple conductive vias 340 (e.g., sixteen separated conductive vias 340) which are formed in the dielectric substrate 110, and two ends of each coupling branch 331 may be connected through two respective conductive vias 340 to two respective connection points on the coil 320. More particularly, the coil 320 may include multiple loops with different sizes, and the coupling structure 330 may include multiple coupling branches 331 with different lengths. The longer coupling branches 331 may be connected to the larger loops, and the shorter coupling branches 331 may be connected to the smaller loops, and so on. In such a design, each loop of the coil 320 may be connected to two respective coupling branches 331 with equal lengths.

The surface E2 of the dielectric substrate 110 may be divided into a left region 111, a central region 112, and a right region 113. The left region 111 may be completely separated from the right region 113 by the central region 112. In some embodiments, the coupling branches 331 of the coupling structure 330 are disposed in the left region 111 and the right region 113 symmetrically. For example, if there are four coupling branches 331 disposed in the left region 111, there will be other four coupling branches 331 disposed in the right region 113 in mirror relationship. The coil 320 has a central clearance region 325. In some embodiments, the coupling branches 331 have vertical projections on the coil 320, and the vertical projections are substantially positioned in the central clearance region 325, but the vertical projections cannot overlap with a center point of the coil 320. In some embodiments, the coupling branches 331 are arranged to be substantially parallel to each other. For example, the coil 320 may substantially have a rectangular shape which has two long sides and two short sides, and the coupling branches 331 may be substantially parallel to the short sides of the rectangular shape. To enhance the coupling energy, the total length L2 of the coupling structure 330 may be shorter than the length L1 of the long side of the rectangular coil 320. For example, the total length L2 of the coupling structure 330 may be about 50% to 80% of the length L1 of the long side of the rectangular coil 320.

In the embodiment of FIG. 3, the total number of coupling branches 331 is 8, and each coupling branch 331 substantially has a square-bracket shape. It is understood that the invention is not limited to the above. In other embodiments, the coupling structure 330 includes more or fewer coupling branches 331, and each coupling branch 331 has a different shape. In other embodiments, the coupling branches 331 are asymmetrically disposed on the surface E2 of the dielectric substrate 110. For example, there may be one coupling branch 331 disposed in the left region 111 of the dielectric substrate 110, but there may be three other coupling branches 331 disposed in the right region 113 of the dielectric substrate 110. Some changed configurations of the NFC antenna of the invention will be described in the following embodiments.

Figure 4A:
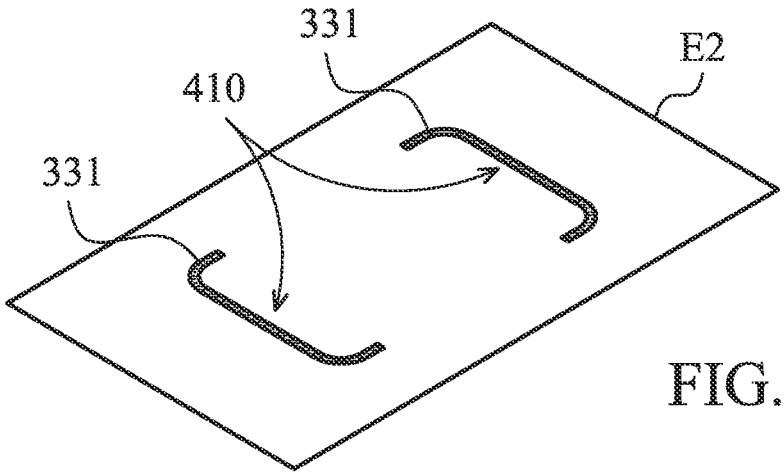
FIG. 4A shows a perspective view of a coupling structure according to an embodiment of the invention.
Figure 4B:
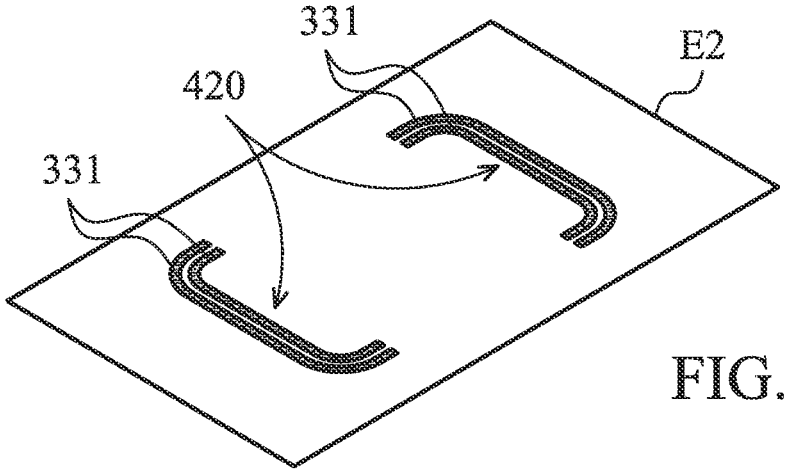
FIG. 4B shows a perspective view of a coupling structure according to an embodiment of the invention.
Figure 4C:
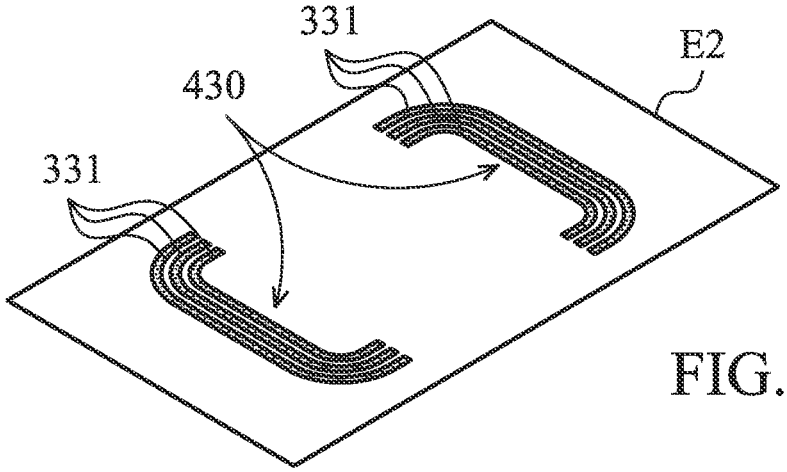
FIG. 4C shows a perspective view of a coupling structure according to an embodiment of the invention.

FIG. 4A shows a perspective view of a coupling structure 410 according to an embodiment of the invention. In the embodiment of FIG. 4A, the coupling structure 410 includes two coupling branches 331 which are symmetrically disposed on the surface E2 of the dielectric substrate 110. FIG. 4B shows a perspective view of a coupling structure 420 according to an embodiment of the invention. In the embodiment of FIG. 4B, the coupling structure 420 includes four coupling branches 331 which are symmetrically disposed on the surface E2 of the dielectric substrate 110. FIG. 4C shows a perspective view of a coupling structure 430 according to an embodiment of the invention. In the embodiment of FIG. 4C, the coupling structure 430 includes six coupling branches 331 which are symmetrically disposed on the surface E2 of the dielectric substrate 110. It is understood that two ends of each of the above coupling branches may be connected to a respective loop of a coil. For example, the longer coupling branches may be connected to the larger loops, and the shorter coupling branches may be connected to the smaller loops, and so on. The coupling structure 330 of FIG. 3 may be replaced with any one of the coupling structures 410, 420, and 430 of FIGS. 4A, 4B, and 4C.

Figure 5A:
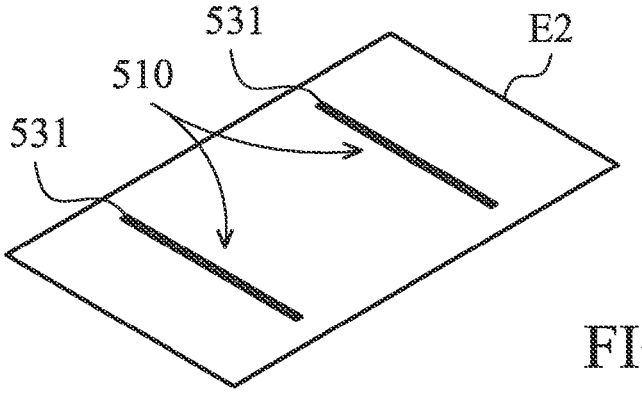
FIG. 5A shows a perspective view of a coupling structure according to an embodiment of the invention.
Figure 5B:
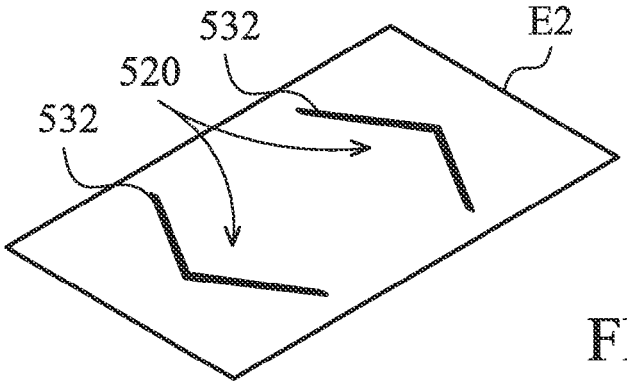
FIG. 5B shows a perspective view of a coupling structure according to an embodiment of the invention.
Figure 5C:
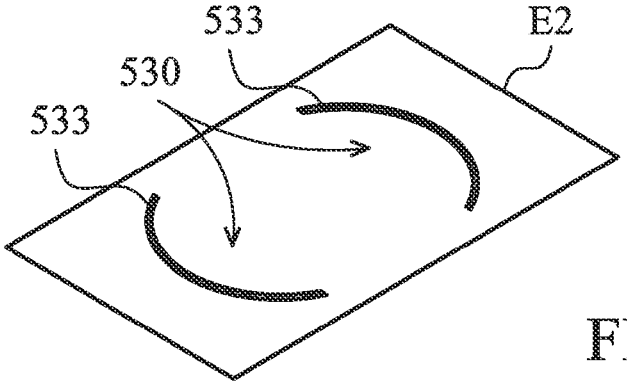
FIG. 5C shows a perspective view of a coupling structure according to an embodiment of the invention.
Figure 5D:
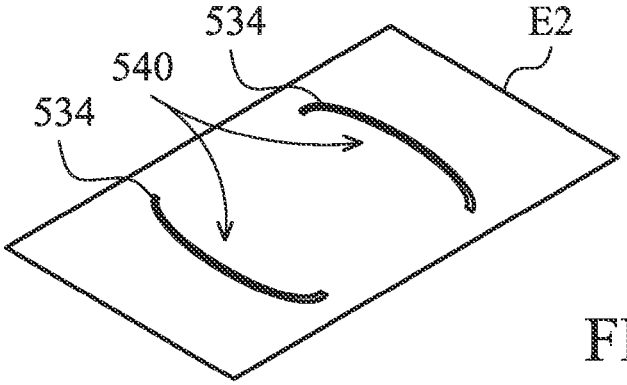
FIG. 5D shows a perspective view of a coupling structure according to an embodiment of the invention.

FIG. 5A shows a perspective view of a coupling structure 510 according to an embodiment of the invention. In the embodiment of FIG. 5A, the coupling structure 510 includes two coupling branches 531, and each coupling branch 531 substantially has a straight-line shape. FIG. 5B shows a perspective view of a coupling structure 520 according to an embodiment of the invention. In the embodiment of FIG. 5B, the coupling structure 520 includes two coupling branches 532, and each coupling branch 532 substantially has a polyline shape. FIG. 5C shows a perspective view of a coupling structure 530 according to an embodiment of the invention. In the embodiment of FIG. 5C, the coupling structure 530 includes two coupling branches 533, and each coupling branch 533 substantially has a semi-circular shape. FIG. 5D shows a perspective view of a coupling structure 540 according to an embodiment of the invention. In the embodiment of FIG. 5D, the coupling structure 540 includes two coupling branches 534, and each coupling branch 534 substantially has a smooth curved shape. It is understood that each of the above coupling structures may include more coupling branches, and two ends of each of the above coupling branches may be connected to a respective loop of a coil. For example, the longer coupling branches may be connected to the larger loops, and the shorter coupling branches may be connected to the smaller loops, and so on. The coupling structure 330 of FIG. 3 may be replaced with any one of the coupling structures 510, 520, 530, and 540 of FIGS. 5A, 5B, 5C, and 5D.

Figure 6B:
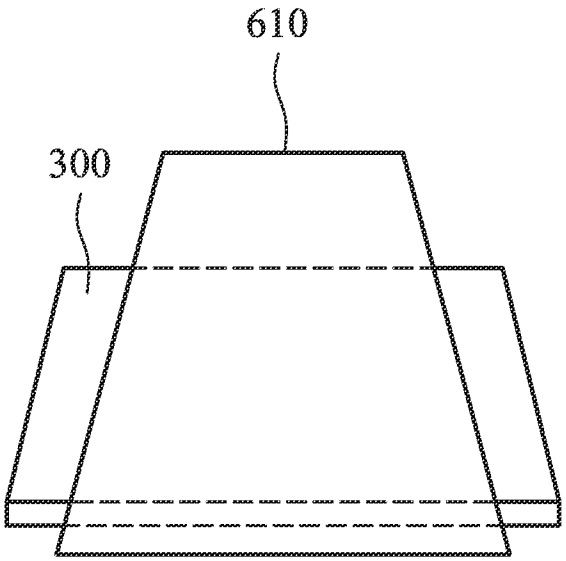
FIG. 6B shows the relative orientation of an NFC antenna and a measurement device according to another embodiment of the invention.
Figure 6A:
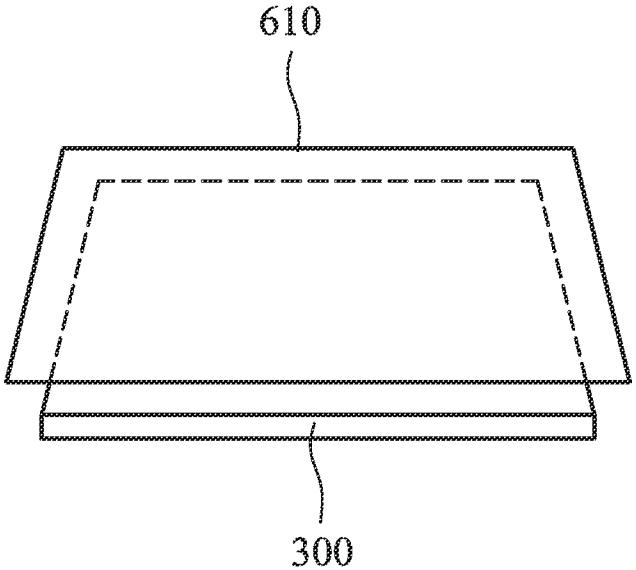
FIG. 6A shows the relative orientation of an NFC antenna and a measurement device according to an embodiment of the invention.

FIG. 6A shows the relative orientation of the NFC antenna 300 and a measurement device 610 according to an embodiment of the invention. FIG. 6B shows the relative orientation of the NFC antenna 300 and the measurement device 610 according to another embodiment of the invention. The measurement device 610 is configured to detect electromagnetic waves transmitted by the NFC antenna 300, and to analyze the intensity of the electromagnetic waves. The measurement device 610 may substantially have a rectangular shape. When the long sides of the measurement device 610 are arranged to be parallel to the long sides of the NFC antenna 300, it is considered that a test angle between the measurement device 610 and the NFC antenna 300 is 0 or 180 degrees (as shown in FIG. 6A). When the long sides of the measurement device 610 are arranged to be perpendicular to the long sides of the NFC antenna 300, it is considered that a test angle between the measurement device 610 and the NFC antenna 300 is 90 or 270 degrees (as shown in FIG. 6B).

Figure 7:
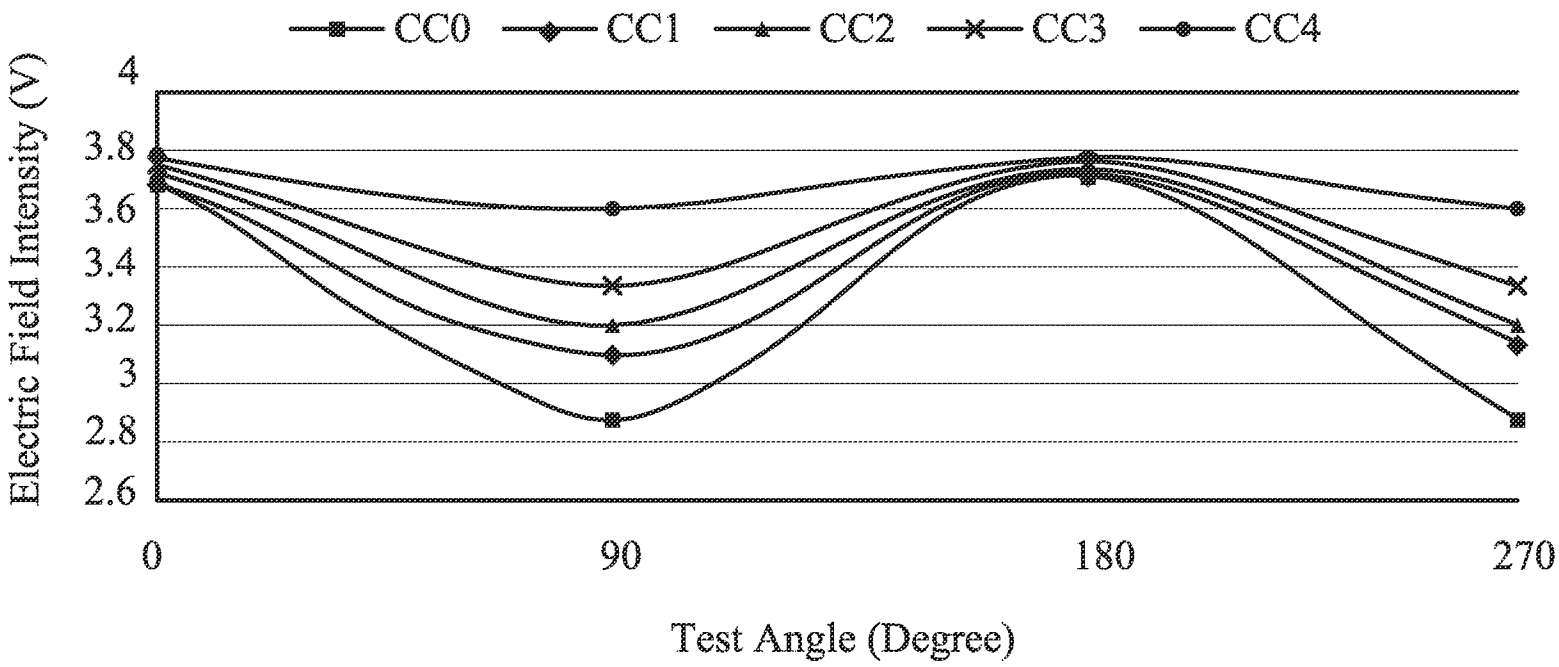
FIG. 7 shows the relationship of electric field intensity of an NFC antenna versus test angle according to an embodiment of the invention.

FIG. 7 shows the relationship of the electric field intensity of the NFC antenna 300 versus the test angle according to an embodiment of the invention. As mentioned above, the measurement device 610 can detect the electric field intensity of the NFC antenna 300 at different test angles, and the measurement results are displayed in FIG. 7. The curve CC0 represents the detected electric field intensity versus the test angle when the coupling structure 330 is removed. The curve CC1 represents the detected electric field intensity versus the test angle when the coupling structure 330 includes two coupling branches (as shown in FIG. 4A). The curve CC2 represents the detected electric field intensity versus the test angle when the coupling structure 330 includes four coupling branches (as shown in FIG. 4B). The curve CC3 represents the detected electric field intensity versus the test angle when the coupling structure 330 includes six coupling branches (as shown in FIG. 4C). The curve CC4 represents the detected electric field intensity versus the test angle when the coupling structure 330 includes eight coupling branches (as shown in FIG. 3). According to the measurement results of FIG. 7, if the coupling structure 330 includes more coupling branches 331 connected to the coil 320, the NFC antenna 300 will provide more uniform electric field intensity at all of the test angles. The coupling structure of the invention can equalize coupling currents of the NFC antenna so as to enhance the total isotropic characteristic of the NFC antenna.

Please refer to FIG. 3 again. In some embodiments, the element sizes and element parameters of the invention may be described as follows. The thickness 111 of the dielectric substrate 110 is less than 2 mm. The coil 320 operates at a frequency of 13.56 MHz. The total area of the coil 320 is about 60×40 $mm^2$. The gap D1 between any adjacent two of the coupling branches 331 is less than 1 mm. The coupling branches 331 have vertical projections on the coil 320, and the vertical projections are substantially in the central clearance region 325. The central clearance region 325 includes a central portion which does not overlap with the vertical projections of the coupling branches 331, and the area of the central portion is about 20×20 $mm^2$.

Note that the above element parameters, element shapes, and frequency ranges are not limitations of the invention. An antenna engineer can adjust these settings or values according to different requirements. It is understood that the NFC antenna of the invention is not limited to the configurations of FIGS. 1-7. The invention may merely include any one or more features of any one or more embodiments of FIGS. 1-7. In other words, not all of the features shown in the figures should be implemented in the NFC antenna of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A near field communication (NFC) antenna, comprising:

a dielectric substrate;

a coil, disposed on the dielectric substrate, wherein the coil has a rectangular shape which has two long sides and two short sides; and a coupling structure, comprising a plurality of coupling branches, wherein each of the coupling branches has two ends respectively connected to two different connection points on the coil, and the coupling branch is interconnected between the two long sides of the coil, wherein the coil and the coupling structure are respectively disposed on two opposite surfaces of the dielectric substrate, and wherein the coil disposed on, the dielectric substrate comprises a left region, a central region, and a right region, the plurality of coupling branches are disposed in the left region and the right region symmetrically, and the left region is completely separated from the right region by the central region.

2. The NFC antenna as claimed in claim 1, wherein the coil is used as a main radiation element of the NFC antenna, and two ends of the coil are respectively connected to a positive electrode and a negative electrode of a signal source.

3. The NFC antenna as claimed in claim 1, wherein the connection points are respectively substantially positioned at the long sides.

4. The NFC antenna as claimed in claim 1, wherein at least two conductive vias are formed in the dielectric substrate, and the ends of the coupling structure are respectively connected through the conductive vias to the connection points on the coil.

5. The NFC antenna as claimed in claim 1, wherein the coil has a central clearance region, the plurality of coupling branches have vertical projections on the coil, and the vertical projections are substantially positioned in the central clearance region.

6. The NFC antenna as claimed in claim 1, wherein a total number of the plurality of coupling branches is two times of a total number of turns of the coil.

7. The NFC antenna as claimed in claim 1, wherein a total number of the plurality of coupling branches is 2, 4, 6, or 8.

8. The NFC antenna as claimed in claim 1, wherein each of the plurality of coupling branches substantially has a straight-line shape, a square-bracket shape, a polyline shape, a semi-circular shape, or a smooth curved shape.

9. The NFC antenna as claimed in claim 1, wherein the plurality of coupling branches are arranged to be substantially parallel to each other.

10. The NFC antenna as claimed in claim 9, wherein the coil substantially has a rectangular shape which has two long sides and two short sides, and the plurality of coupling branches are substantially parallel to the short sides.

11. The NFC antenna as claimed in claim 1, wherein gap between any adjacent two of the plurality of coupling branches is less than 1 mm.

12. The NFC antenna as claimed in claim 1, wherein the dielectric substrate is a flame retardant 4 (FR4) substrate.

13. The NFC antenna as claimed in claim 1, wherein a thickness of the dielectric substrate is less than 2 mm.

14. The NFC antenna as claimed in claim 1, wherein the coil operates at a frequency of 13.56 MHz.

* * * * *